US011560283B2

(12) United States Patent
Morisaki

(10) Patent No.: US 11,560,283 B2
(45) Date of Patent: Jan. 24, 2023

(54) SHEET FEEDING APPARATUS, IMAGE READING APPARATUS, AND IMAGE FORMING APPARATUS

(71) Applicant: Ryohei Morisaki, Kanagawa (JP)

(72) Inventor: Ryohei Morisaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/460,522

(22) Filed: Aug. 30, 2021

(65) Prior Publication Data

US 2022/0081247 A1 Mar. 17, 2022

(30) Foreign Application Priority Data

Sep. 15, 2020 (JP) ..... JP2020-154820

(51) Int. Cl.

| | |
|---|---|
| ***B65H 31/26*** | (2006.01) |
| ***B65H 29/60*** | (2006.01) |
| ***G03G 15/00*** | (2006.01) |
| ***B65H 29/12*** | (2006.01) |

(52) U.S. Cl.

CPC ..... *B65H 29/60* (2013.01); *B65H 29/12* (2013.01); *G03G 15/6529* (2013.01)

(58) Field of Classification Search

None

See application file for complete search history.

(56) References Cited

U.S. PATENT DOCUMENTS

| | | | | |
|---|---|---|---|---|
| 6,142,469 | A * | 11/2000 | Nanba | B65H 31/10 270/58.08 |
| 7,392,983 | B2 * | 7/2008 | Kodama | B65H 37/04 270/58.08 |
| 7,419,150 | B2 * | 9/2008 | Kushida | B65H 31/26 270/58.11 |
| 7,607,659 | B2 * | 10/2009 | Fukatsu | B65H 31/26 271/220 |
| 7,731,169 | B2 * | 6/2010 | Saito | B65H 31/26 270/58.11 |
| 7,922,163 | B2 * | 4/2011 | Ichihashi | B65H 31/34 270/58.11 |

(Continued)

FOREIGN PATENT DOCUMENTS

| | | |
|---|---|---|
| JP | 7-300270 | 11/1995 |
| JP | 2006-248717 | 9/2006 |
| JP | 2007-176689 | 7/2007 |

*Primary Examiner* — Leslie A Nicholson, III

(74) *Attorney, Agent, or Firm* — Harness, Dickey & Pierce, P.L.C.

(57) ABSTRACT

A sheet feeder includes an ejection tray, an ejector, an aligner, a pressing member, a friction member, and a switching device. The ejection tray stacks sheets. The ejector ejects a sheet to the ejection tray. The aligner is disposed downstream of the ejector in a direction of ejection of the sheet. The aligner is rotatable in a normal direction and a reverse direction. The pressing member applies pressure between the sheet and the aligner to enable the aligner to convey the sheet by rotation in the normal direction and the reverse direction. The friction member contacts the sheet ejected on the ejection tray to prevent conveyance of the sheet. The switching device switches contact and separation of the friction member with respect to the sheet.

17 Claims, 15 Drawing Sheets

(56) References Cited

U.S. PATENT DOCUMENTS

| | | | | |
|---|---|---|---|---|
| 8,123,209 | B2 * | 2/2012 | Kubota | G03G 15/6541 270/58.08 |
| 8,162,305 | B2 * | 4/2012 | Hattori | B65H 39/10 270/58.08 |
| 8,393,616 | B2 * | 3/2013 | Kubota | G03G 15/6552 271/220 |
| 8,459,639 | B2 * | 6/2013 | Nagao | B65H 31/26 271/220 |
| 2012/0080836 | A1 | 4/2012 | Morisaki | |
| 2015/0329308 | A1 | 11/2015 | Iwata et al. | |
| 2015/0329309 | A1 | 11/2015 | Iwata et al. | |
| 2016/0355364 | A1 | 12/2016 | Shibata et al. | |
| 2021/0087007 | A1 | 3/2021 | Morisaki et al. | |

* cited by examiner

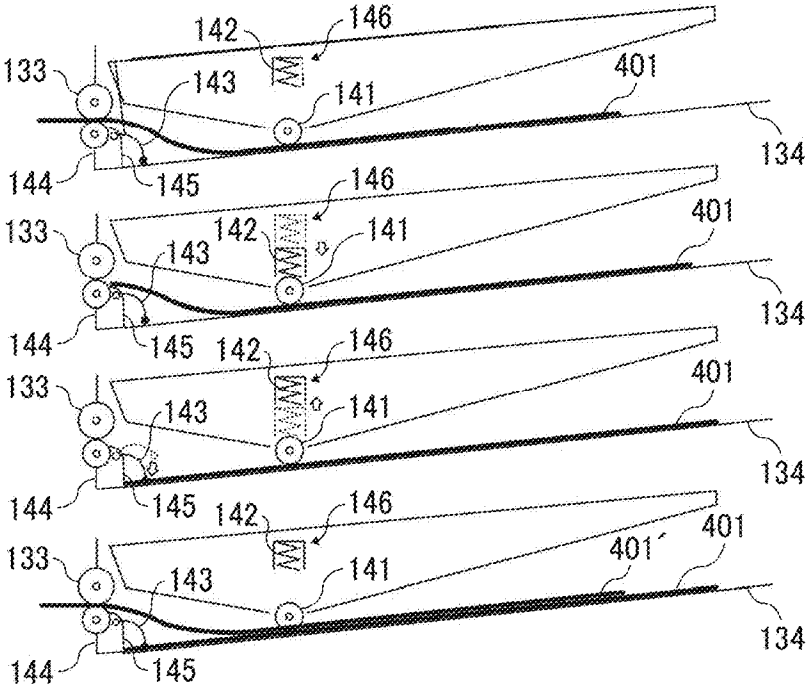
FIG. 7A
FIG. 7B
FIG. 7C
FIG. 7D
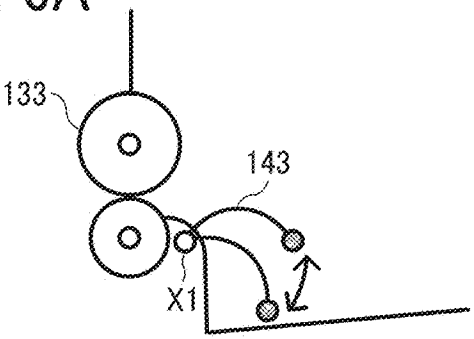
FIG. 6A
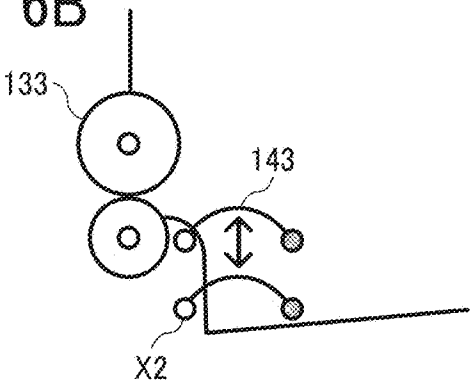
FIG. 6B

SHEET FEEDING APPARATUS, IMAGE READING APPARATUS, AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-154820, filed on Sep. 15, 2020, in the Japan Patent Office, the entire disclosure of which is hereby incorporated by reference herein.

BACKGROUND

Technical Field

Embodiments of the present disclosure relate to a sheet feeding apparatus, an image reading apparatus, and an image forming apparatus.

Related Art

In order to align ejected sheets while restraining an increase in the size of the entire machine, there is a technology for improving stackability by bringing a movable ejection driving roller into contact with a sheet on an ejection tray and conveying the sheet to an ejection end fence, instead of making the inclination of the ejection tray gentle. For example, a configuration has been proposed in which an ejected sheet is pulled back to an ejection end fence by a movable ejection roller for the purpose of improving the stackability of the ejected sheet. Further, a configuration has been proposed in which a movable sheet pressing member is brought into contact with stacked sheets for the purpose of improving the stackability of the ejected sheet.

SUMMARY

According to an embodiment of the present disclosure, there is provided a sheet feeder that includes an ejection tray, an ejector, an aligner, a pressing member, a friction member, and a switching device. The ejection tray stacks sheets. The ejector ejects a sheet to the ejection tray. The aligner is disposed downstream of the ejector in a direction of ejection of the sheet. The aligner is rotatable in a normal direction and a reverse direction. The pressing member applies pressure between the sheet and the aligner to enable the aligner to convey the sheet by rotation in the normal direction and the reverse direction. The friction member contacts the sheet ejected on the ejection tray to prevent conveyance of the sheet. The switching device switches contact and separation of the friction member with respect to the sheet.

According to another embodiment of the present disclosure, there is provided an image reading device including the sheet feeder.

According to still another embodiment of the present disclosure, there is provided an image forming apparatus including the sheet feeder.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIGS. 6A and 6B are diagrams illustrating configuration examples of a trailing-end presser;

FIGS. 7A to 7D are cross-sectional views illustrating a schematic configuration of an ADF according to an embodiment of the present disclosure;

Figure 1:
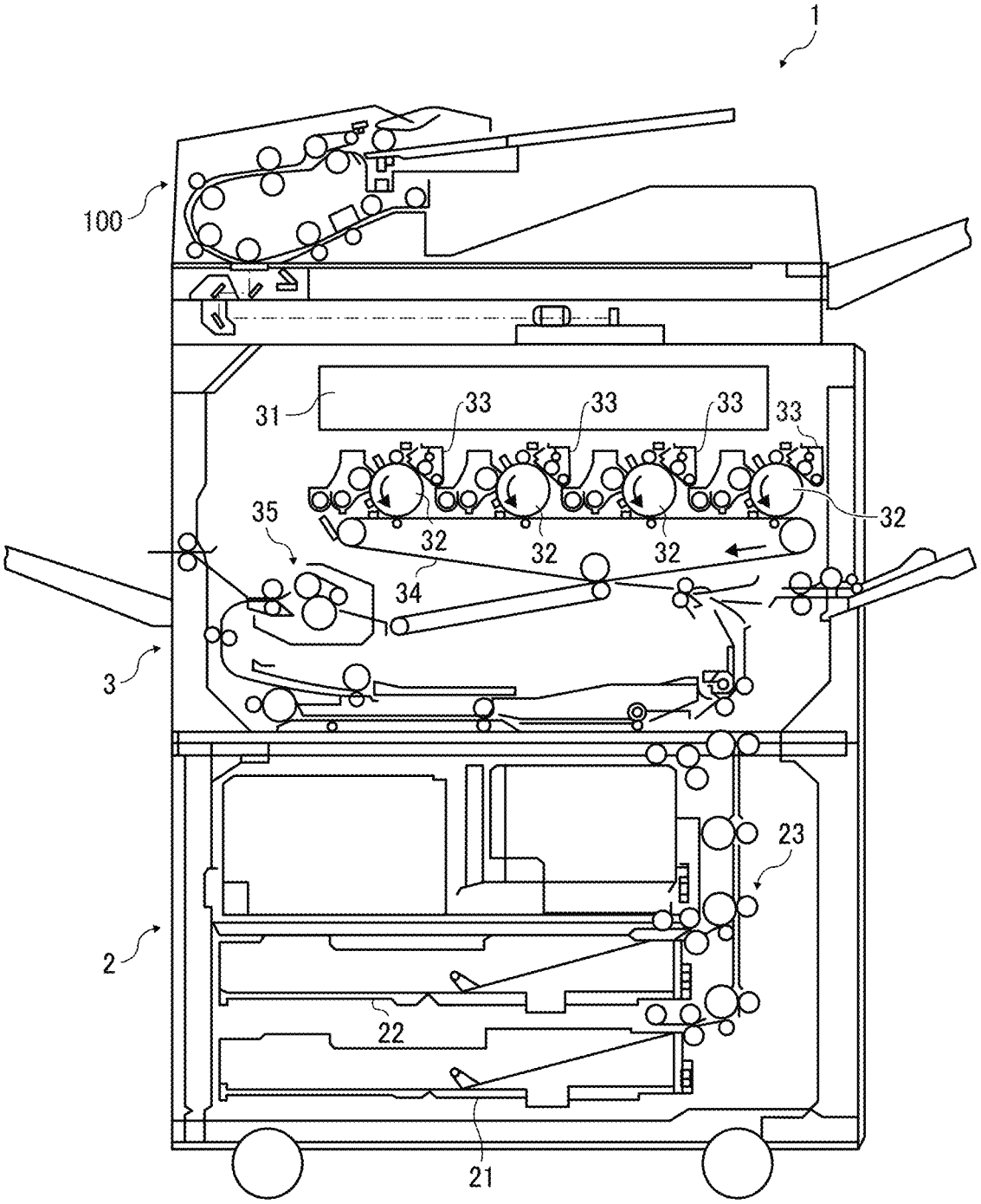
FIG. 1 is a diagram illustrating a schematic configuration of a copier serving as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, embodiments of a sheet feeder, an image reading device, and an image forming apparatus according to embodiments of the present disclosure are described in detail with reference to the accompanying drawings. According to embodiments of the present disclosure, for example, a sheet of paper is ejected to a small-inclination ejection tray as follows. 1. A document ejected from an ejection roller is ejected between a reversible alignment roller and an ejection tray. 2. When the trailing edge of the document passes through the ejection roller, the alignment roller descends and is pressed by a pressing mechanism, and the document is conveyed by the alignment roller. 3. The conveyance of the document is stopped at the timing at which the trailing edge of the document moves beyond the trailing-end presser, and the trailing-end presser is raised. 4. The alignment roller is rotated in reverse to stop the document at a position where the trailing edge of the document abuts against an end fence of the ejection tray, and the trailing-end presser is fixed to hold the document. 5. When the next document is ejected, the preceding document is fixed by the friction member. Accordingly, the co-feeding of the next document and the preceding document does not occur. In short, according to embodiments of the present disclosure, the sheet ejection stackability is enhanced by the trailing-end presser and the alignment roller in the ejection tray having a small inclination. With reference to drawings, embodiments of the present disclosure are described below in detail with reference to the drawings, Note that the embodiments described below are described with an example of a copier. However, embodiments of the present disclosure are not limited to the modes exemplified below and can be implemented in various modes without departing from the spirit of the present disclosure.

FIG. 1 is a diagram illustrating a schematic configuration of a copier serving as an image forming apparatus according to an embodiment of the present disclosure. As illustrated in FIG. 1, a copier 1 includes an auto document feeder (ADF) 100, a sheet feeding section 2, and an image forming section 3. The ADF 100 serving as a sheet feeder has a function of an image reading device. The sheet feeding section 2 includes sheet trays 21 and 22 and a sheet roller unit 23. Different sizes of recording media are placed on the sheet trays 21 and 22. The sheet roller unit 23 includes a plurality of roller pairs that convey recording media from the sheet trays 21 and 22 to an image forming position at which the image forming section 3 forms images on the recording media.

The image forming section 3 includes an exposure device 31, photoconductor drums 32, developing devices 33, a transfer belt 34, and a fixing device 35. The image forming section 3 exposes the photoconductor drums 32 with the exposure device 31 according to image data of a document read by an image reader inside the ADF 100 to form latent images on the photoconductor drums 32 and supplies toner of different colors to the photoconductor drums 32 by the developing device 33 to develop the latent images on the photoconductor drums 32. The image forming section 3 transfers toner images developed on the photoconductor drums 32 by the transfer belt 34 to a recording sheet supplied from the sheet feeding section 2 and fuses the toners of the toner images transferred to the recording sheet by the fixing device 35 to fix a composite color image to the recording sheet.

Figure 2:
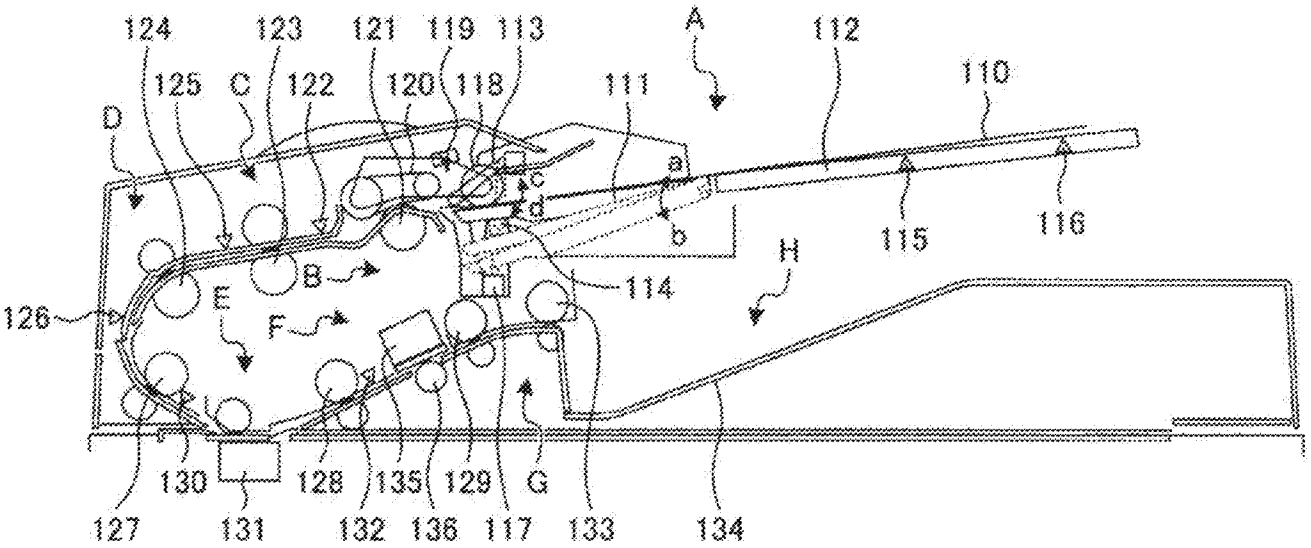
FIG. 2 is a diagram illustrating a detailed configuration of an automatic document feeder (ADF) according to an embodiment of the present disclosure.
Figure 3:
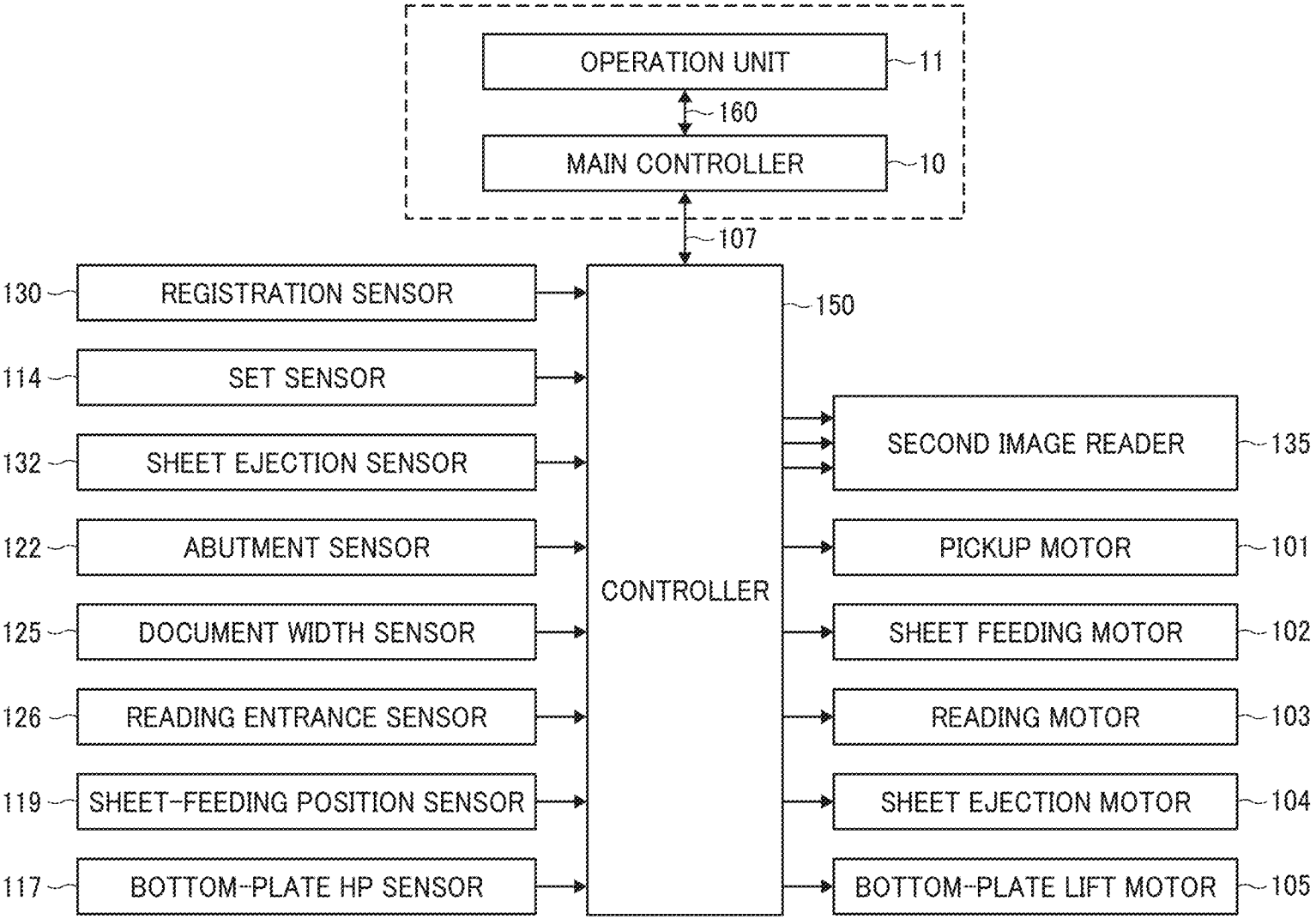
FIG. 3 is a block diagram of a control system of the ADF, according to an embodiment of the present disclosure.

FIG. 2 is a diagram illustrating a detailed configuration of the ADF 100. FIG. 3 is a block diagram of a control system of the ADF 100. As illustrated in FIG. 2, the ADF 100 includes a document setting section A, a separation feeding section B, a registration section C, a turning section D, a first reading conveyance section E, a second reading conveyance section F, a sheet ejection section G, and a stack section H. A stack of documents is set on the document setting section A. The separation feeding section B separates and feeds documents one by one from the stack of documents. The registration section C performs primary striking alignment of a document fed from the separation feeding section B and pulls out and conveys the document after alignment. The turning section D turns the conveyed document and conveys the document so that an original surface of the document faces a reading side (a lower side in FIG. 2) of a first image reader 131. The first reading conveyance section E reads a front-side image of the document from below of an exposure glass by the first image reader 131. The second reading conveyance section F reads a back surface image of a document after a front-side image of the document is read by a second image reader 135. The sheet ejection section G ejects the document whose front-side and back-side images have been read to the outside of the ADF 100. Documents ejected from the sheet ejection section G are stacked and held on the stack section H.

As illustrated in FIG. 3, the ADF 100 further includes motors 101 to 105 that perform driving in the above-described sections and a controller 150 that controls a series of operations. The controller 150 is connected to a main-body control unit 10 that performs overall control of the copier 1 via an interface (I/F) 107. An operation unit 11 through which a user performs various operations is connected to the main-body control unit 10 via an I/F 106.

A document stack 110 to be read is set on the document setting section A. The document stack 110 is set on a document table 112 including a movable document table 111. The document stack 110 is set on the document table 112 with a document surface to be read facing upward. A side guide aligns the position of the document stack 110 in the width direction, in other words, a direction orthogonal to a conveyance direction of the documents. The setting of the document stack 110 is detected with a setting feeler 113 and a setting sensor 114. Data indicating that the document stack 110 has been set is transmitted from the controller 150 to the main-body control unit 10 via the I/F 107.

The outline of the length of the document stack 110 in the conveyance direction is determined with the document-length detection sensors 115 and 116 provided on the surface of the document table. As the document-length detection sensors 115 and 116, for example, a reflection type sensor or an actuator type sensor capable of detecting even one document is used. The document-length detection sensors 115 and 116 are arranged so that the document-length detection sensor 115 and 116 can determine at least whether the document size is vertical or horizontal.

The movable document table 111 is vertically movable in directions a and b in FIG. 2 by a bottom-plate lifting motor 105. When the document stack 110 is not set on the document table 112, the movable document table 111 is in a lowered state. This lowered state is detected by a bottom-plate home position (HP) sensor 117. When the setting feeler 113 and the setting sensor 114 detect that the document stack 110 is set on the document table 112, the controller 150 rotates the bottom-plate lifting motor 105 in a forward direction to raise the movable document table 111 so that the uppermost surface of the document stack 110 contacts a pickup roller 118 of the separation feeding section B. When the pickup motor 101 operates the pickup roller 118 in the directions c and d in FIG. 2 by the action of a cam mechanism, the movable document table 111 is raised and the pickup roller 118 is pushed by the upper surface of the document stack 110 on the movable document table 111.

Accordingly, the pickup roller 118 is raised in the direction c in FIG. 2 by the movable document table 111, so that the upper limit can be detected by a sheet-feed proper-position sensor 119.

When a print key of the operation unit 11 is pressed and a document feed signal is transmitted from the main-body control unit 10 to the controller 150 via the I/F 107, the pickup roller 118 is driven to rotate by the forward rotation of a sheet feeding motor 102 to pick up several (ideally one) documents on the document table 112. The rotation direction is a direction in which the uppermost document is conveyed to a sheet feed port.

The sheet feeding belt 120 is driven in the sheet feeding direction by the forward rotation of the sheet feeding motor 102. The reverse roller 121 is driven to rotate in a direction opposite to the sheet feeding direction by the forward rotation of the sheet feeding motor 102. Accordingly, the uppermost document is separated from the document below the uppermost document, thus allowing only the uppermost document to be fed. More specifically, the reverse roller 121 contacts the sheet feeding belt 120 at a predetermined pressure. In the state in which the reverse roller 121 is in contact with the sheet feeding belt 120 directly or via one sheet of document, the reverse roller 121 is dragged by the rotation of the sheet feeding belt 120 to rotate in the counterclockwise direction. On the other hand, the drag force is set to be lower than the torque of a torque limiter when two or more documents enter between the sheet feeding belt 120 and the reverse roller 121. In such a case, the reverse roller 121 rotates in the clockwise direction, which is the original driving direction, to push back an extra document. Thus, multi-feeding of documents can be prevented.

The document separated into one sheet by the action of the sheet feeding belt 120 and the reverse roller 121 is sent toward the registration section C by the sheet feeding belt 120. After the leading edge of the document is detected with a contact sensor 122, the document further advances and contacts against a pull-out roller pair 123 that is stopped. Thereafter, the document is fed by a predetermined distance from the detection of the contact sensor 122. In a state in which the document is pressed against the pull-out roller pair 123 with a predetermined amount of deflection, the sheet feeding motor 102 is stopped. Thus, the driving of the sheet feeding belt 120 is stopped. At this time, the pickup motor 101 is rotated to retract the pickup roller 118 from the upper surface of the document, and the document is fed only by the conveying force of the sheet feeding belt 120. Accordingly, the leading edge of the document enters the nipping portion of upper and lower rollers of the pull-out roller pair 123, and alignment of the leading edge (skew correction) is performed.

The pull-out roller pair 123 has the skew correction function, is a pair of rollers that convey the document subjected to the skew correction after separation to an intermediate roller 124, and is driven by the reverse rotation of the sheet feeding motor 102. When the sheet feeding motor 102 rotates in the reverse direction, the pull-out roller pair 123 and the intermediate roller 124 are driven and the pickup roller 118 and the sheet feeding belt 120 are not driven.

A plurality of document width sensors 125 are arranged in the depth direction of FIG. 2 and detect the size of the document conveyed by the pull-out roller pair 123 in the width direction orthogonal to the conveyance direction. The contact sensor 122 reads the leading edge and trailing edge of the document to detect the length of the document in the conveyance direction from a motor pulse.

When the document is conveyed from the registration section C to the turning section D by driving of the pull-out roller pair 123 and the intermediate roller 124, the conveyance speed of the document in the registration section C is set to be higher than the conveyance speed in the first reading conveyance section E, so that the processing time for feeding the document to the image reader is shortened. When the leading edge of the document is detected with the reading entrance sensor 126, deceleration of the document is started to make the document conveyance speed equal to the reading conveyance speed before the leading edge of the document enters the nipping portion of the pair of upper and lower rollers of the reading entrance roller 127. At the same time, the reading motor 103 is driven to rotate in the forward direction to drive the reading entrance roller 127, the reading exit roller 128, and the CIS exit roller 129. When the leading edge of the document is detected with the registration sensor 130, the controller 150 reduces the conveyance speed of the document by a predetermined conveying distance, temporarily stops the document before the first image reader 131, and transmits a registration stop signal to the main-body control unit 10 via, the I/F 107.

Subsequently, when a reading start signal is transmitted from the main-body control unit 10 to the controller 150 via the I/F 107, the controller 150 increases the conveyance speed of the document, which has been stopped for registration, so as to rise to a predetermined conveyance speed before the leading edge of the document reaches the position of the first image reader 131, and conveys the document. At this time, the position of the leading edge of the document is detected by the pulse count of the reading motor 103. At the timing when the leading edge of the document reaches the first image reader 131, a gate signal indicating an effective image area in the sub-scanning direction, which is the same direction as the conveyance direction of the document, of the surface of the document is transmitted to the main-body control unit 10. The gate signal is continuously transmitted until the trailing edge of the document passes through the first image reader 131. While the document is conveyed by the driving of the reading entrance roller 127 and the reading exit roller 128, the front-side image of the document is read by the first image reader 131.

In the case of single-sided document reading, the document whose front-side image has been read by the first image reader 131 of the first reading conveyance section E passes through the second reading conveyance section F as it is and is conveyed to the sheet ejection section G. At this time, when the leading edge of the document is detected by the ejection sensor 132, the controller 150 drives the ejection motor 104 to rotate forward to rotate an ejection roller 133 counterclockwise. The controller 150 reduces the driving speed of the ejection motor 104 immediately before the trailing edge of the document exits from the nipping portion between a pair of upper and lower ejection rollers including the ejection roller 133, based on the pulse count of the ejection motor 104 from the detection of the leading edge of the document by the ejection sensor 132. Thus, the controller 150 controls the document to be ejected onto the ejection tray 134 of the stack section H not to jump out.

On the other hand, in the case of double-sided document reading, the position of the leading edge of the document being conveyed is detected based on the pulse count of the reading motor 103 from the detection of the leading edge of the document by the ejection sensor 132. A gate signal indicating an effective image area in the sub-scanning direction of the back side of the document is transmitted from the controller 150 to the second image reader 135 at the timing when the leading edge of the document reaches the position of the second image reader 135 of the second reading conveyance section F. The gate signal is continuously transmitted until the trailing edge of the document passes through the second image reader 135. While the document is conveyed by the driving of the reading exit roller 128 and the CIS exit roller 129, the second image reader 135 reads a back-side image of the document in the document flow reading method (sheet-through reading). The second reading roller 136 disposed facing the second image reader 135 restrains floating of the document in the second image reader 135 and also serves as a reference white portion for acquiring shading data in the second image reader 135.

Figures 4A, 4B, 4C, 4D:
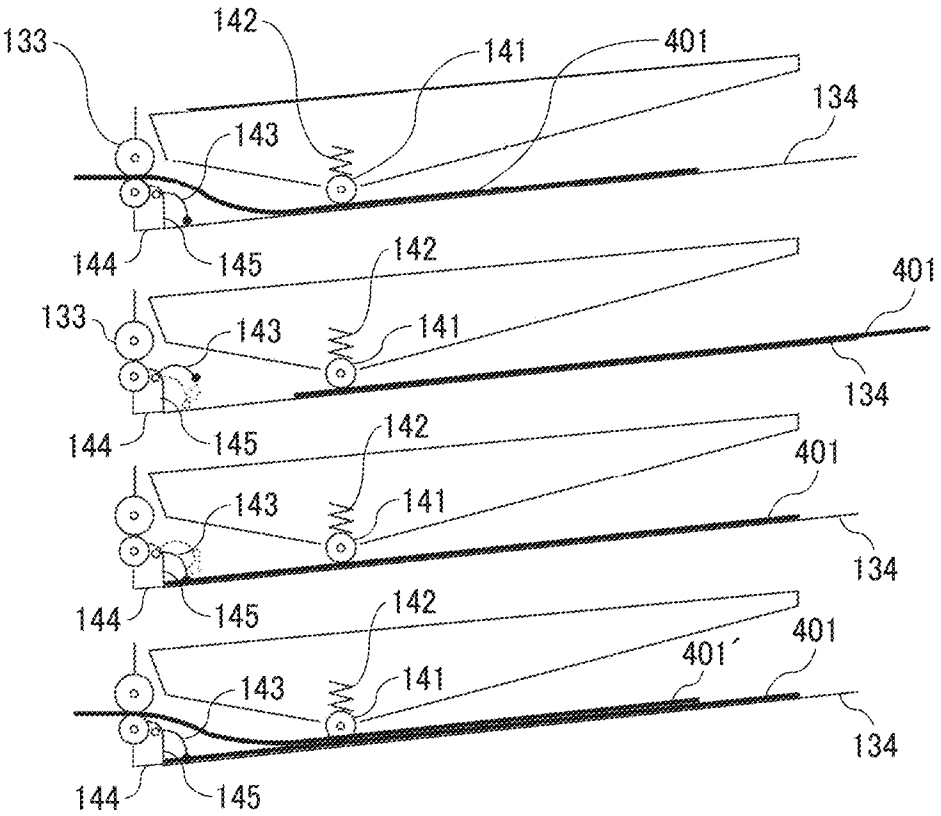
FIGS. 4A to 4D are cross-sectional views illustrating a schematic configuration of an ADF according to an embodiment of the present disclosure.
Figure 5:
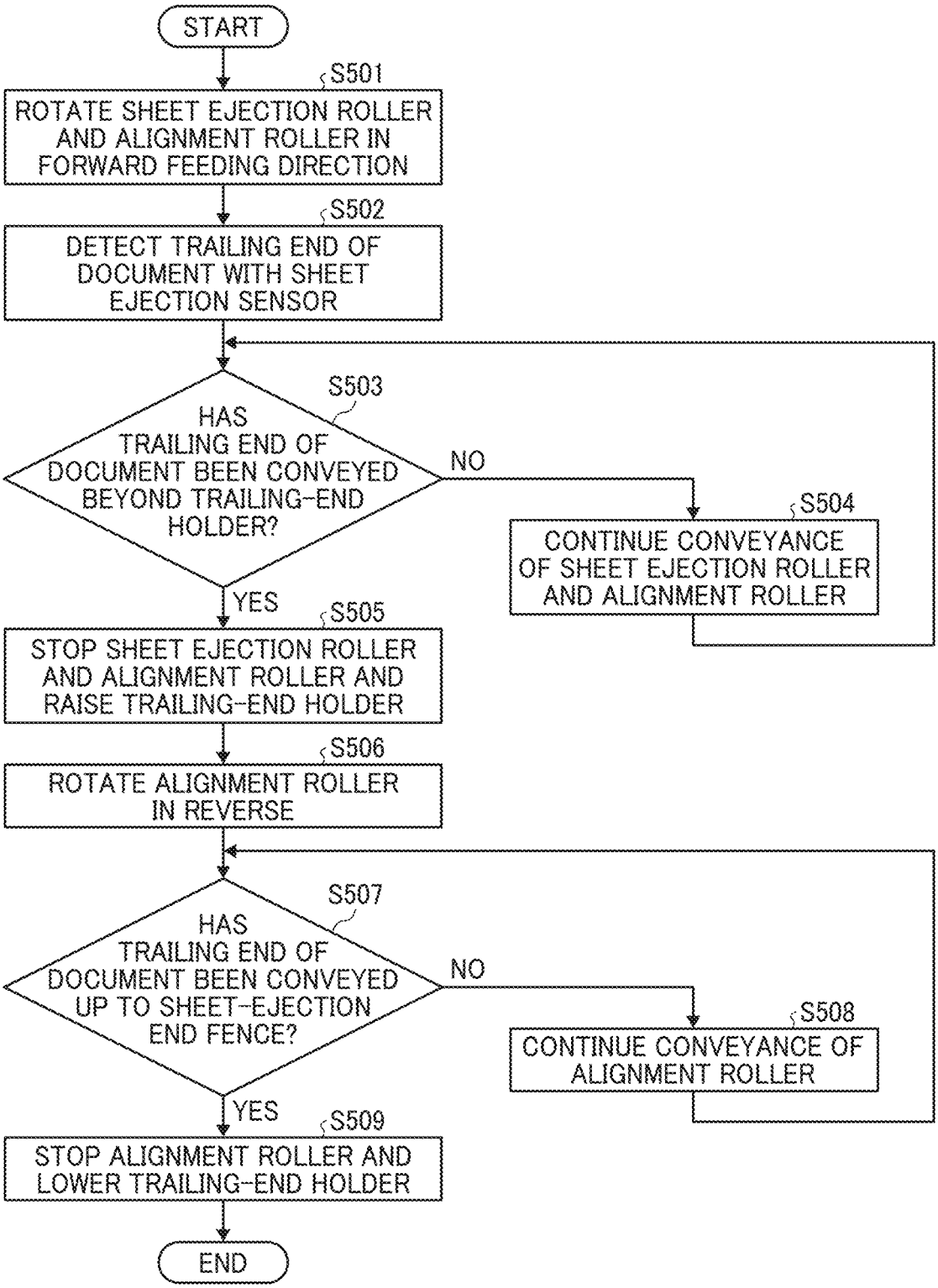
FIG. 5 is a flowchart of sheet conveyance in the ADF illustrated in FIG. 4.

FIG. 4 is a cross-sectional view illustrating a schematic configuration of the ADF 100 according to a first embodiment of the present disclosure. FIG. 5 is a flowchart illustrating sheet conveyance in the ADF 100 according to the first embodiment. In the ADF 100, a document 401 ejected from the ejection roller 133 (ejector) is ejected between a reversible alignment roller 141 (aligner), which is rotatable in a normal direction and a reverse direction, and the ejection tray 134. At this time, the alignment roller 141 is pressed by a pressing member 142 (for example, an elastic member such as a spring) and is rotated in the conveyance direction of the document to apply the conveying force to the document (see FIG. 4A).

Based on the timing at which the trailing edge of the document 401 has passed over the ejection sensor 132, the alignment roller 141 is stopped at the timing at which the trailing edge of the document passes over the trailing-end presser 143. The trailing-end presser 143 is raised by the switching device 144 (see FIG. 4B).

When the trailing-end presser 143 is raised, the alignment roller 141 starts conveying the document toward the ejection end fence 145 and stops the document at a position where the trailing edge of the document abuts against the ejection end fence 145 based on the timing at which the trailing edge of the document has passed the ejection sensor 132. After the trailing edge of the document abuts against the ejection end fence 145, the trailing-end presser 143 is lowered by the switching device 144 to hold the document (see FIG. 4C).

When the next document 401' is ejected, the ejected document is held by the trailing-end presser 143. Accordingly, the ejection of the next document by the ejection roller 133 and the accompanying feeding of the ejected document by the alignment operation of the next document by the alignment roller 141 can be restrained (see FIG. 4D). In order to prevent ejection and stacking of the next document, the alignment roller 141 is made of a member having a frictional force smaller than that of the ejection roller 133 (the nipping portion).

In FIGS. 4A to 4D, the pressing member 142 presses the alignment roller 141. However, in some embodiments, the pressing member 142 may press the document from the side of the ejection tray 134 via a sliding member made of, for example, polyoxymethylene (POM). FIG. 4 and subsequent drawings may be described below with a plurality of documents (for example, documents 401 and 401') that are conveyed. The sizes of such documents may be different.

To be more specific, as illustrated in FIG. 5, the controller 150 causes the ejection roller 133 and the alignment roller 141 to rotate in the forward feed direction (S501) and confirms that the ejection sensor 132 has detected the trailing edge of the document 401 (S502). The controller 150 determines whether the trailing edge of the document 401 has been conveyed to a position beyond the trailing-end presser 143 (S503). If the controller 150 determines that the document 401 has not been conveyed until the trailing edge of the document 401 passes over the trailing-end presser 143 (NO in S503), the controller 150 causes the ejection roller 133 and the alignment roller 141 to continue the conveyance of the document 401 (S504). Alternatively, when the controller 150 determines that the trailing edge of the document 401 has been conveyed to a position beyond the trailing-end presser 143 (YES in S503), the controller 150 stops the ejection roller 133 and the alignment roller 141 and causes the switching device 144 to raise the trailing-end presser 143 (S505).

When the trailing-end presser 143 is raised, the controller 150 causes the alignment roller 141 to reversely rotate to start conveying the document 401 toward the ejection end fence 145 (S506). The controller 150 determines whether the trailing edge of the document has been conveyed to the ejection end fence 145, based on the timing at which the trailing edge of the document has passed through the ejection sensor 132 (S507). When the controller 150 determines that the trailing edge of the document has not been conveyed to the ejection end fence 145 (NO in S507), the controller 150 causes the alignment roller 141 to continue the conveyance of the document 401 (S508). Alternatively, if the controller 150 determines that the trailing edge of the document 401 has been conveyed to the ejection end fence 145 (YES in S507), the controller 150 stops the alignment roller 141 and causes the switching device 144 to lower the trailing-end presser 143 (S509). The number and arrangement of the alignment roller 141 are preferably the same as those of the ejection roller 133.

FIGS. 6A and 6B are diagrams illustrating configuration examples of the trailing-end presser 143. A document contact portion of the trailing-end presser 143 is preferably made of a friction member having a high friction coefficient such as rubber. The friction member is made of a member having a friction force larger than that of the alignment roller 141 or the ejection roller 133 (the nipping portion) in order to prevent the co-feed of the ejected document. As illustrated in FIGS. 6A and 6B, the switching device 144 may switch the separation of the trailing-end presser 143 from the document in any movement manner such as a rotational movement (FIG. 6A) about a rotation shaft X1 and a linear movement (FIG. 6B) in which a support shaft X2 is moved along the vertical direction that is the pressing direction of the trailing-end presser 143. As a mechanism of the switching device 144 that moves the trailing-end presser 143, any of various rotation mechanisms and lifting mechanisms known in the related art may be used. Further, the trailing-end presser 143 may be configured to be hidden inside the ejection tray or the ejection end fence when the trailing-end presser 143 is raised.

As described above, the ADF 100 described with reference to FIGS. 4 to 6 includes the ejection tray 134, the ejector (for example, the ejection roller 133), the reversible aligner (for example, the alignment roller 141), the pressing member 142, the friction member (for example, the trailing-end presser 143), and the switching device 144. Sheets (for example, documents 401) are stacked on the ejection tray 134. The ejector (for example, the ejection roller 133) ejects sheets to the ejection tray. The reversible aligner (for example, the alignment roller 141) is located downstream from the ejector. The pressing member (for example, the pressing member 142) applies pressure between a sheet and the aligner to allow the aligner to convey the sheet in forward and reverse directions. The friction member (for example, the trailing-end presser 143) contacts the sheet ejected onto the ejection tray to prevent conveyance. The switching device 144 switches contact and separation of the friction member. Such a configuration can restrain an increase in the size (in the height direction) of the entire machine, prevent the co-feed of an ejected sheet and a stacked sheet, and reliably improve the stacking performance of ejected sheets by a small-sized machine.

Figure 8:
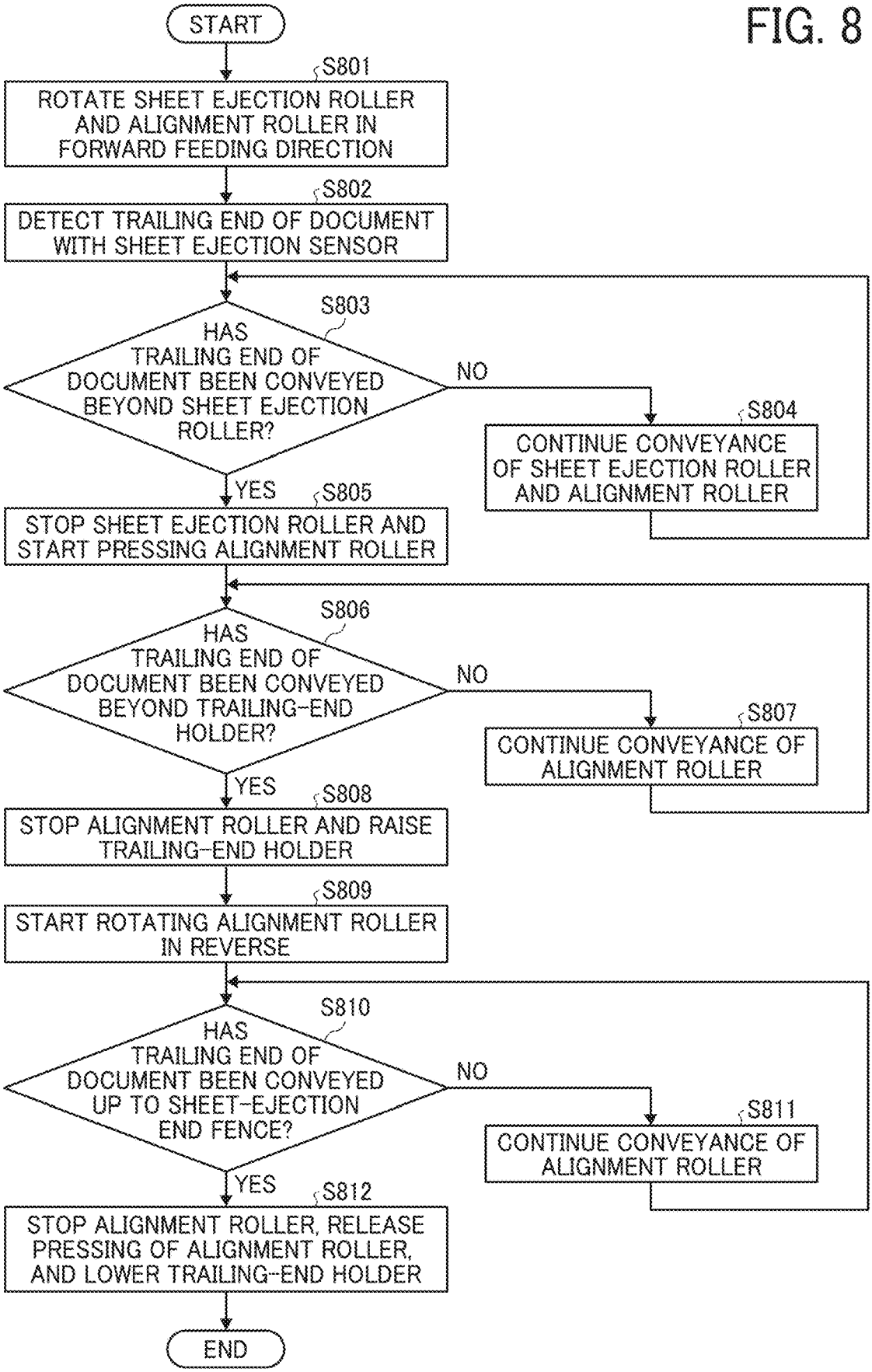
FIG. 8 is a flowchart illustrating sheet conveyance of the ADF illustrated in FIGS. 7A to 7D.

FIGS. 7A, 7B, 7C, and 7D are cross-sectional views illustrating a schematic configuration of an ADF 100 according to a second embodiment of the present disclosure. FIG. 8 is a flowchart illustrating sheet conveyance in the ADF 100 according to the second embodiment. The ADF 100 according to the second embodiment includes a retreat device 146 (for example, an actuator, which is the same hereinafter) that can switch ON and OFF of pressing (in other words, the presence and absence of pressure transmission) of the pressing member 142 against the aligner (for example, the alignment roller 141) in the configuration according to the first embodiment. As described below, in the ADF 100 according to the second embodiment, the pressure applied to the aligner is released by the retreat device, thus allowing the ejected sheet to enter between the aligner and the ejection tray. Accordingly, the alignment operation of the ejected sheet by the aligner can be reliably performed.

In FIGS. 7A to 7D, the pressing by the pressing member 142 is turned off until the trailing edge of the document 401 is ejected from the ejection roller 133 (FIG. 7A).

Based on the timing at which the trailing edge of the document has passed over the ejection sensor 132, the pressing of the pressing member 142 is turned on when the timing at which the trailing edge of the document 401 is ejected from the ejection roller 133 has come. Thus, control is performed so that the conveying force is transmitted from the alignment roller 141 to the ejected document (FIG. 7B).

The pressing is switched to OFF at the timing when the trailing edge of the document 401 abuts against the ejection end fence 145 (FIG. 7C).

This switching prevents an unnecessary conveying force from being transmitted to the ejected document during the alignment operation of the ejected document. Accordingly, the occurrence of co-feeding of the ejected document and the stacked document can be further restrained (FIG. 7D).

In FIGS. 7A to 7D, a jogger mechanism that aligns the document 401 in the width direction may be added to the above-described configuration. After the alignment roller 141 abuts the trailing edge of the document 401 against the ejection end fence 145, the controller 150 may cause the jogger mechanism to align the document 401 in the width direction and then cause the trailing-end presser 143 to be lowered. In such an order, the document 401 may be aligned in the width direction. In order to prevent ejection and stacking of the next document, the alignment roller 141 is made of a member having a frictional force smaller than that of the ejection roller 133 (the nipping portion). The friction member of the trailing-end presser 143 is made of a member having a friction force larger than that of the alignment roller 141 or the ejection roller 133 (the nipping portion) in order to prevent the co-feed of the ejected document.

To be more specific, as illustrated in FIG. 8, the controller 150 causes the ejection roller 133 and the alignment roller 141 to rotate in the forward feed direction (S801) and confirms that the ejection sensor 132 has detected the trailing edge of the document 401 (S802). The controller 150 determines whether the trailing edge of the document 401 has been conveyed to a position beyond the ejection roller 133 (S803). If the controller 150 determines that the trailing edge of the document 401 has not been conveyed beyond the ejection roller 133 (NO in S803), the controller 150 causes the ejection roller 133 and the alignment roller 141 to continue the conveyance of the document 401 (S804). Alternatively, when the controller 150 determines that the trailing edge of the document 401 has been conveyed to a position beyond the ejection roller 133 (YES in S803), the controller 150 stops the ejection roller 133 and causes the retreat device 146 to start pressing the alignment roller 141 (S805).

The controller 150 determines whether the trailing edge of the document 401 has been conveyed to a position beyond the trailing-end presser 143 (S806). If the controller 150 determines that the document 401 has not been conveyed until the trailing edge of the document 401 passes over the trailing-end presser 143 (NO in S806), the controller 150 causes the alignment roller 141 to continue the conveyance of the document 401 (S807). Alternatively, when the controller 150 determines that the trailing edge of the document 401 has been conveyed to a position beyond the trailing-end presser 143 (YES in S806), the controller 150 stops the alignment roller 141 and causes the switching device 144 to raise the trailing-end presser 143 (S808).

When the trailing-end presser 143 is raised, the controller 150 causes the alignment roller 141 to reversely rotate to start conveying the document 401 toward the ejection end fence 145 (S809). The controller 150 determines whether the trailing edge of the document has been conveyed to the ejection end fence 145, based on the timing at which the trailing edge of the document has passed through the ejection sensor 132 (S810). When the controller 150 determines that the trailing edge of the document has not been conveyed to the ejection end fence 145 (NO in S810), the controller 150 causes the alignment roller 141 to continue the conveyance of the document 401 (S811). Alternatively, when the controller 150 determines that the trailing edge of the document 401 has been conveyed to the ejection end fence 145 (YES in S810), the controller 150 stops the alignment roller 141, releases the pressure applied to the alignment roller 141 by the retreat device 146, and causes the switching device 144 to lower the trailing-end presser 143 (S812). The number and arrangement of the alignment roller 141 are preferably the same as those of the ejection roller 133.

In an ADF 100 according to a third embodiment of the present disclosure, the relation among the friction coefficient $\mu 1$ and the pressing force P1 of the trailing-end presser 143, the friction coefficient $\mu 2$ of the alignment roller 141, and the pressing force P2 of the pressing member 142 is $\mu 1 \times P1 > \mu 2 \times P2$. The force by which an ejected document tries to entrain a stacked document varies depending on, for example, the friction coefficient of the document, the close contact state, and electrostatic charge, but does not exceed the force of $\mu 2 \times P2$ by which the alignment roller 141 conveys the ejected document. Accordingly, the force by which the friction member prevents conveyance of a sheet is greater than the conveying force that a sheet conveyed by the alignment roller applies to a sheet stacked on the ejection tray. Further, when the relation with the document conveying force F3 of the ejection roller 133 is $\mu 1 \times P1 > F3$, the configuration is advantageous for prevention of co-feed. As described above, in the ADF 100 according to the third embodiment, the force by which the friction member (for example, the trailing-end presser 143) prevents conveyance of a sheet is larger than the conveying force that the sheet conveyed by the aligner (for example, the alignment roller 141) applies to a sheet stacked on the ejection tray 134. Such a configuration can reliably prevent a stacked sheet from being fed together with an ejected sheet.

Figure 9A:
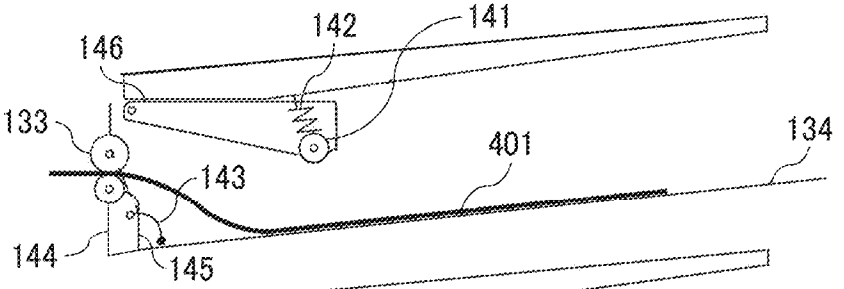
FIGS. 9A and 9B are cross-sectional views illustrating a schematic configuration of am ADF according to an embodiment of the present disclosure.
Figure 9B:
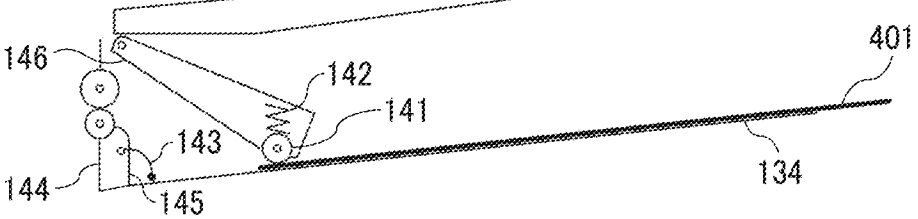
Figure 10:
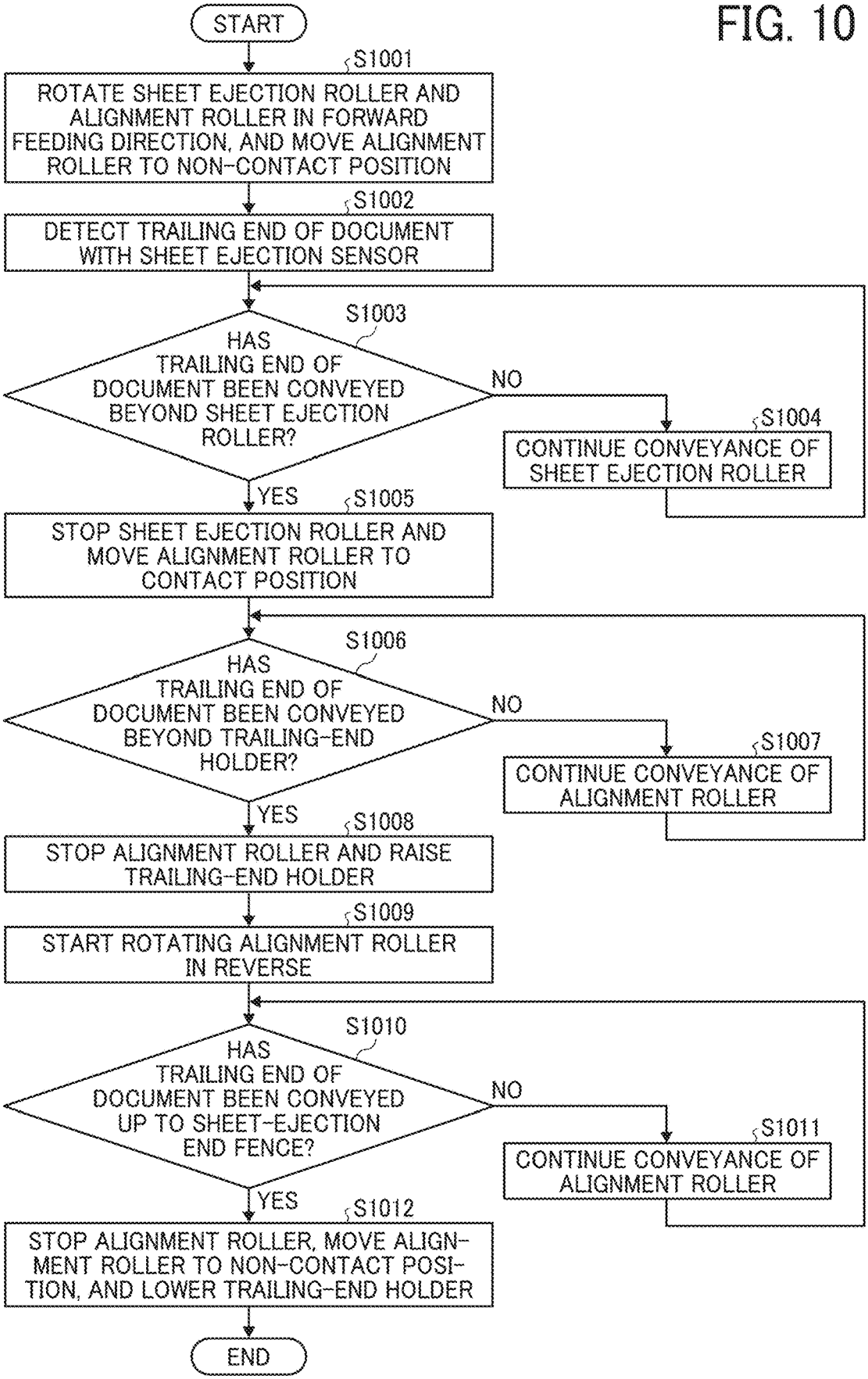
FIG. 10 is a flowchart illustrating sheet conveyance of the ADF illustrated in FIGS. 9A and 9B.

FIGS. 9A and 9B are cross-sectional views illustrating a schematic configuration of an ADF 100 according to a fourth embodiment of the present disclosure. FIG. 10 is a flowchart illustrating sheet conveyance in the ADF 100 according to the fourth embodiment. The ADF 100 according to the fourth embodiment has a configuration in which, in the configuration of the second or third embodiment, the alignment roller 141 and the ejected document are brought into contact with each other (FIG. 9B) when the pressure is turned on by the retreat device 146, and the alignment roller 141 and the ejected document are separated from each other (FIG. 9A) when the pressure is turned off. This configuration allows more documents to be stacked between the alignment roller 141 and the ejection tray 134. That is, in the ADF 100 according to the fourth embodiment, a clearance can be provided between the aligner and the sheet by the retreat device, thus allowing the number of stacked sheets to be increased. In order to prevent ejection and stacking of the next document, the alignment roller 141 is made of a member having a frictional force smaller than that of the ejection roller 133 (the nipping portion). The friction member of the trailing-end presser 143 is made of a member having a friction force larger than that of the alignment roller 141 or the ejection roller 133 (the nipping portion) in order to prevent the co-feed of the ejected document.

To be more specific, as illustrated in FIG. 10, while the ejection roller 133 and the alignment roller 141 are rotating in the forward feed direction, the controller 150 turns off the pressing by the retreat device 146 and causes the alignment roller 141 to move to a non-contact position (S1001), and confirms that the ejection sensor 132 has detected the trailing edge of the document 401 (S1002). The controller 150 determines whether the trailing edgy; of the document 401 has been conveyed to a position beyond the ejection roller 133 (S1003). If the controller 150 determines that the trailing edge of the document 401 has not been conveyed beyond the ejection roller 133 (NO in S1003), the controller 150 causes the ejection roller 133 to continue the conveyance of the document 401 (S1004). Alternatively, when the controller 150 determines that the trailing edge of the document 401 has been conveyed to a position beyond the ejection roller 133 (YES in S1003), the controller 150 stops the ejection roller 133, turns on the pressure applied by the retreat device 146, and moves the alignment roller 141 to the contact position (S1005).

The controller 150 determines whether the trailing edge of the document 401 has been conveyed to a position beyond the trailing-end presser 143 (S1006). If the controller 150 determines that the document 401 has not been conveyed until the trailing edge of the document 401 passes over the trailing-end presser 143 (NO in S1006), the controller 150 causes the alignment roller 141 to continue the conveyance of the document 401 (S1007). Alternatively, when the controller 150 determines that the trailing edge of the document 401 has been conveyed to a position beyond the trailing-end presser 143 (YES in S1006), the controller 150 stops the alignment roller 141 and causes the switching device 144 to raise the trailing-end presser 143 (S1008).

When the trailing-end presser 143 is raised, the controller 150 causes the alignment roller 141 to reversely rotate to start conveying the document 401 toward the ejection end fence 145 (S1009). The controller 150 determines whether the trailing edge of the document has been conveyed to the ejection end fence 145, based on the timing at which the trailing edge of the document has passed through the ejection sensor 132 (S1010). When the controller 150 determines that the trailing edge of the document has not been conveyed to the ejection end fence 145 (NO in S1010), the controller 150 causes the alignment roller 141 to continue the conveyance of the document 401 (S1011). Alternatively, when the controller 150 determines that the trailing edge of the document 401 has been conveyed to the ejection end fence 145 (YES in S1010), the controller 150 stops the alignment roller 141, turns off the pressing by the retreat device 146, causes the alignment roller 141 to the non-contacting position, and causes the switching device 144 to lower the trailing-end presser 143 (S1012). The number and arrangement of the alignment roller 141 are preferably the same as those of the ejection roller 133.

Figure 11A:
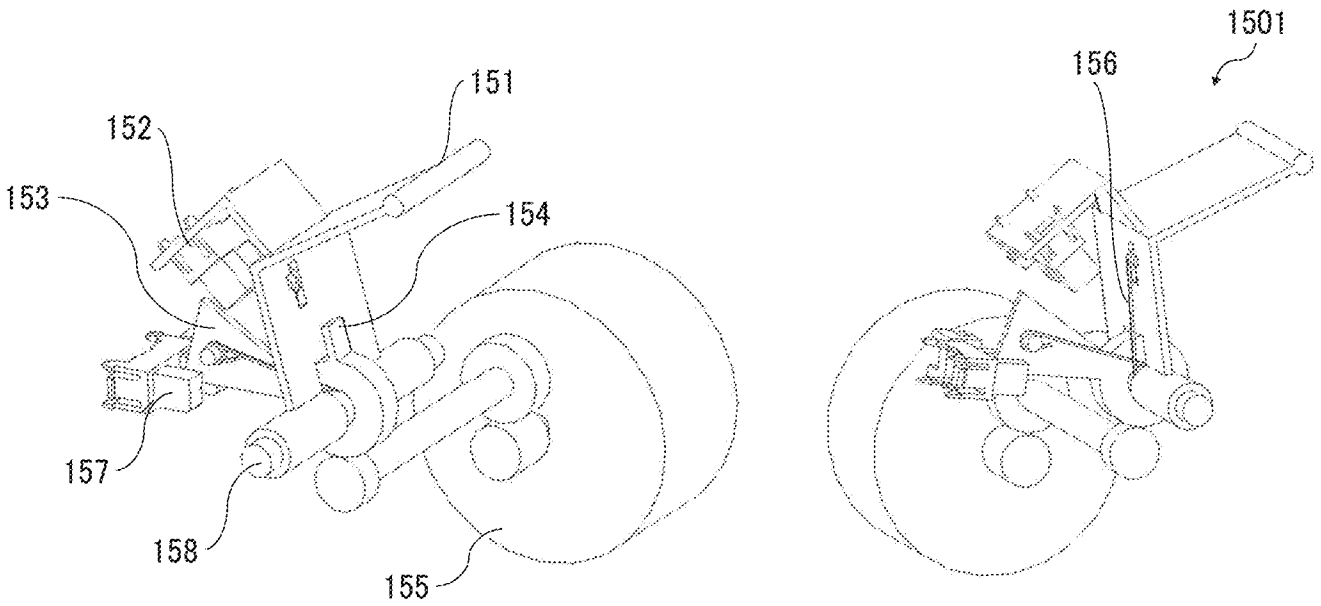
FIGS. 11A to 11D are schematic views illustrating an example of a detector.

FIG. 11A is a schematic view of a detector 1501 according to a fifth embodiment. The detector 1501 includes a detection arm 151, a pressure detection sensor 152, a pressure detection feeler 153, a detection arm stopper 154, a stepping motor 155, a torsion spring 156, an initial sensor 157, and a support shaft 158. The detector 1501 is controlled by the controller 150. As described below, in the detector 1501 according to the fifth embodiment, the contact state by the retreat device can be controlled so that the pressing force by the pressing member is maintained at a constant value. Accordingly, even if the number of stacked sheets changes, the conveyance of sheets by the aligner can be constantly maintained in an optimum state. The detection arm 151 and the pressure detection feeler 153 are rotatably attached to a support shaft 158. The pressure detection feeler 153 is connected to a stepping motor shaft via a gear. The pressure detection sensor 152 and the initial sensor 157 are transmissive sensors and detect the pressure detection feeler 153.

In the initial state, the pressure detection feeler 153 is placed at a specific detection position with respect to the initial sensor 157 (FIG. 11A).

Figure 11B:
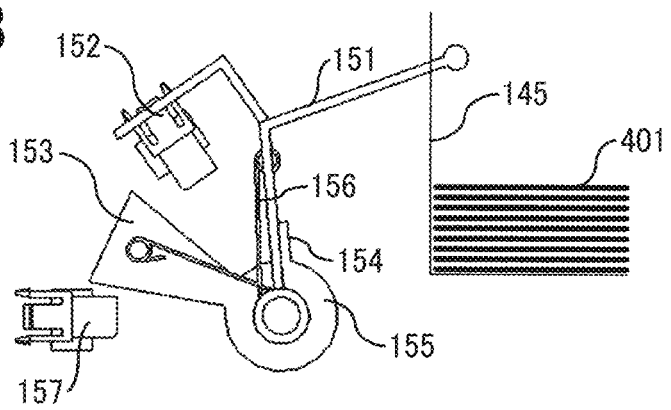

When the pressure detection feeler 153 is rotated by the rotation of the stepping motor 155, the detection arm 151 is also rotated by the torsion spring 156 (FIG. 11B).

Figure 11C:
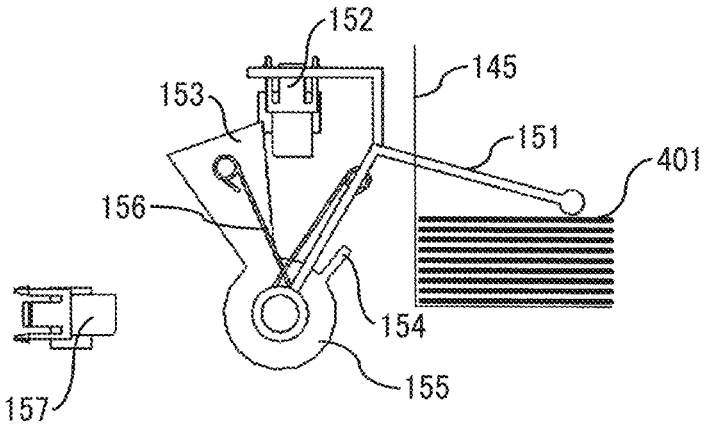

When the detection arm 151 contacts the ejection tray 134 or the stacked document while the stepping motor 155 is rotating, the detection arm 151 stops rotating. On the other hand, the pressure detection feeler 153 continues rotating (FIG. 11C).

Figure 11D:
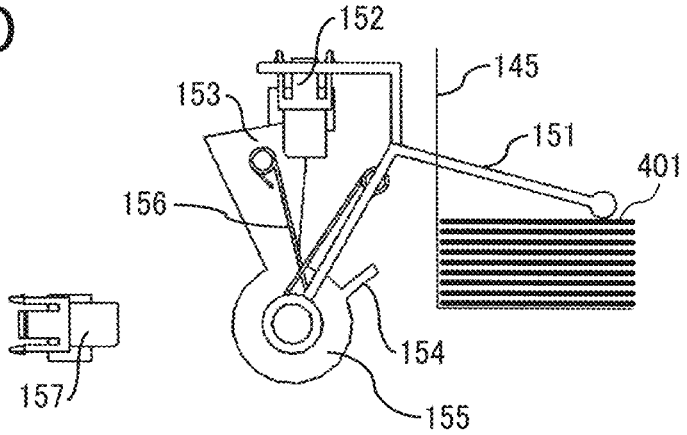

When the pressure detection sensor 152 as a transmissive sensor detects the pressure detection feeler 153, the stepping motor 155 stops rotating (FIG. 11D). In this configuration, the number of steps of the stepping motor 155 from when the rotation of the detection arm 151 is stopped to when the pressure detection sensor 152 detects the pressure detection feeler 153 is always constant. Accordingly, the controller 150 can calculate the angle of the ground surface of the detection arm 151 from the number of steps of the stepping motor 155 in a period from the initial state to the detection of the pressure detection feeler 153 by the pressure detection sensor 152, and can further calculate the stacking height of the stacked sheets from the angle.

Since the stacking height of the stacked sheets can be detected by the detector 1501 as described above, control can be performed such that the pressing force by the pressing member 142 is maintained at a constant value by rotating the retreat device 146 by an appropriate angle based on information on the stacking height. In order to correctly measure the stacking height of the stacked sheets, it is desirable that the detector 1501 is disposed near the trailing-end presser 143 that presses the stacked sheets.

Figure 12:
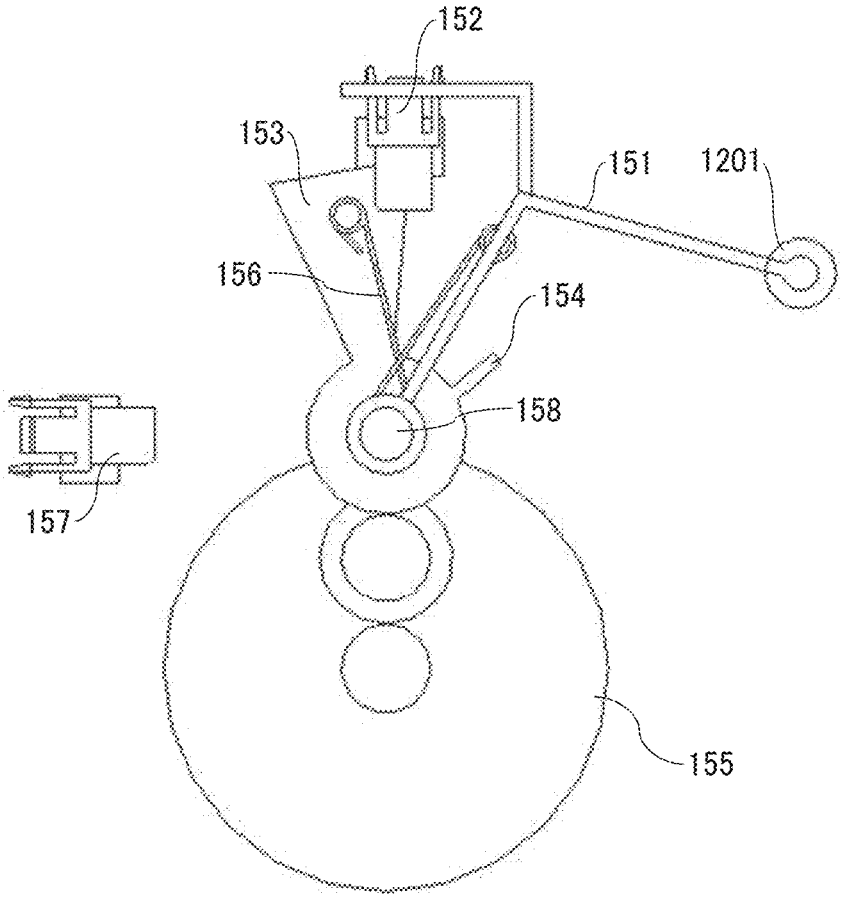
FIG. 12 is a diagram illustrating a schematic configuration of an ADF according to an embodiment of the present disclosure.

FIG. 12 is a schematic diagram of a sixth embodiment. An ADF 100 according to the sixth embodiment has a configuration in which, in the configuration of the fifth embodiment, the detection arm 151 has a role of the trailing-end presser 143, and a front-end portion of the detection arm 151 is made of a friction member 1201 made of rubber or the like having a high friction coefficient equal to or higher than a predetermined value. In the ADF 100 according to the sixth embodiment, the height of the aligner can be controlled by the contact height of the friction member with respect to the stacked sheets. Accordingly, it is not necessary to separately prepare a detector that detects the stacking height of the stacked sheets, thus allowing cost reduction.

FIGS. 13A to 13F are cross-sectional views illustrating a schematic configuration of an ADF 100 according to a seventh embodiment of the present disclosure. FIG. 14 is a flowchart illustrating sheet conveyance in the ADF 100 according to the seventh embodiment. In the ADF 100 according to the seventh embodiment, as described below, for example, the switching device 144 presses the entire trailing end portion of the stack sheet toward the ejection tray 134, using the branch plate 160 instead of the trailing-end presser 143 (or together with the trailing-end presser 143) according to the first to sixth embodiments. Such a configuration can prevent the curl of the trailing end portion of the stack sheet from contacting the front end of the ejected sheet to cause jamming. For example, the switching device 144 moves the branch plate 160 that switches the conveyance path of the sheet, and switches the conveyance path of the sheet while switching between contact and separation of the friction member 161.

Figure 13A:
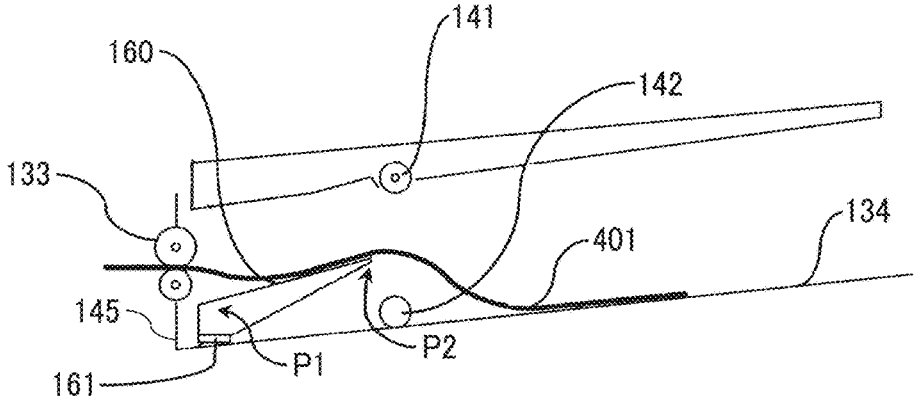
FIGS. 13A to 13F are cross-sectional views illustrating a schematic configuration of am ADF according to an embodiment of the present disclosure.
Figure 14:
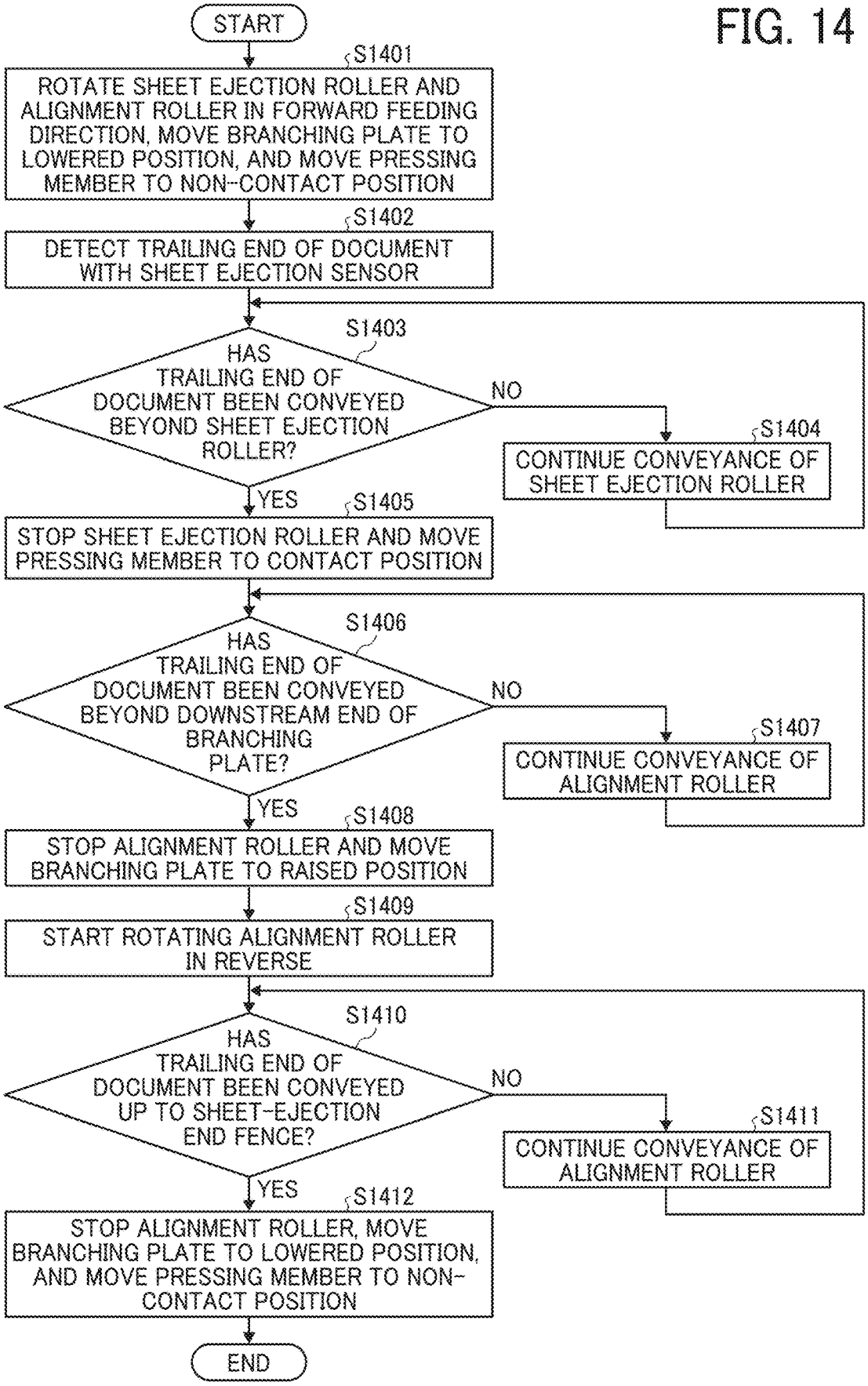
FIG. 14 is a flowchart illustrating sheet conveyance of the ADF illustrated in FIGS. 13A to 13F.

In the ADF 100 according to the seventh embodiment, the document 401 ejected from the ejection roller 133 passes through an upper path of the branch plate 160 and is ejected between the reversible alignment roller 141 and the pressing member 142 (FIG. 13A).

The number and arrangement of the alignment roller 141 are the same as those of the ejection roller 133. Using a roller with a flange or a sponge material having a diameter larger than that of the roller to impart stiffness to the document 401 can restrain the ejected document from contacting the stacked document. Accordingly, further enhancement of the stacking performance can be expected. The branch plate 160 desirably has such a shape and structure that an upstream end portion P1 of the branch plate 160 is lower than the nipping portion of the ejection roller 133, and a downstream end portion P2 of the branch plate 160 is higher than the pressing member 142.

Figure 13B:
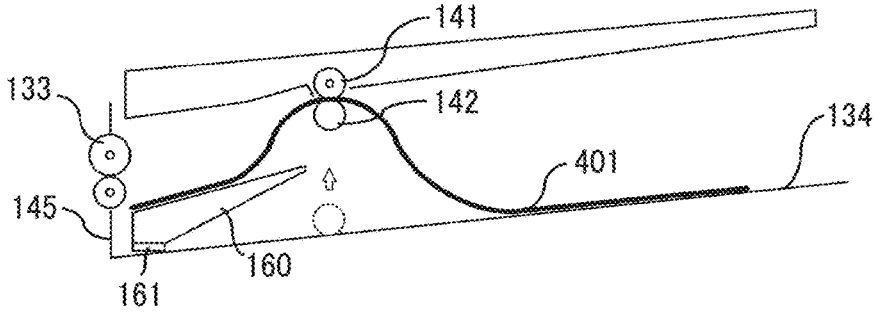

Based on the timing at which the trailing edge of the document 401 has passed the ejection sensor 132, when the trailing edge of the document 401 has passed the sheet ejection roller 133, the pressing member 142 is raised by a retreat device similar to the retreat device 146 illustrated in FIGS. 7A to 7D and the ejected document is conveyed by the alignment roller 141 (FIG. 13B). The control of raising the pressing member 142 may be configured to maintain a specific conveying force even when the number of stacked sheets increases, using a configuration such as the detector 1501 of the fifth embodiment.

Figure 13C:
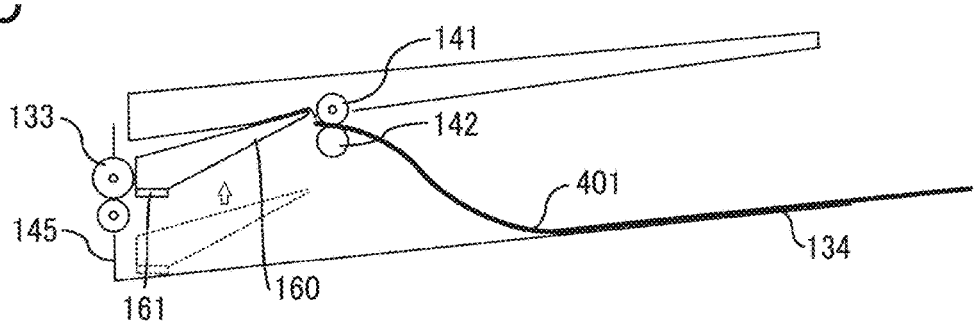

Based on the timing at which the trailing edge of the document passes through the ejection sensor 132, when the trailing edge of the document reaches the timing at which the trailing edge of the document passes over the downstream end portion P2 of the branch plate 160, the conveyance of the alignment roller 141 is stopped and the branch plate 160 is raised (FIG. 13C). At this time, it is desirable that the downstream end portion P2 of the branch plate 160 is higher than the pressing member 142.

Figure 13D:
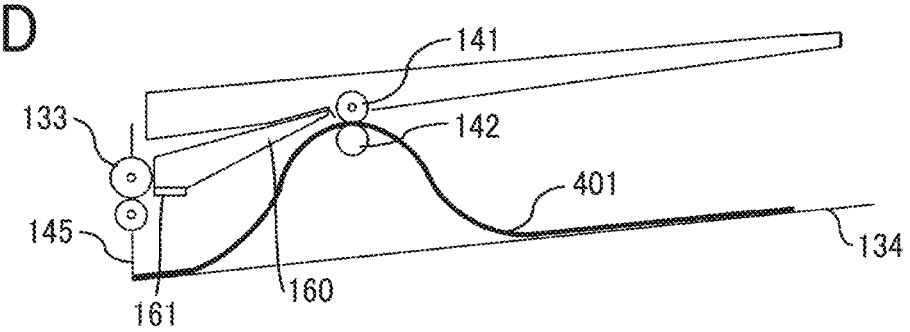

When the raising of the branch plate 160 is completed, the ejected document is conveyed by the alignment roller 141 through a lower path of the branch plate 160 based on the timing at which the trailing edge of the document passes through the ejection sensor 132. The alignment roller 141 is stopped at the timing at which the trailing edge of the document abuts against the ejection end fence 145 (FIG. 13D).

Figure 13E:
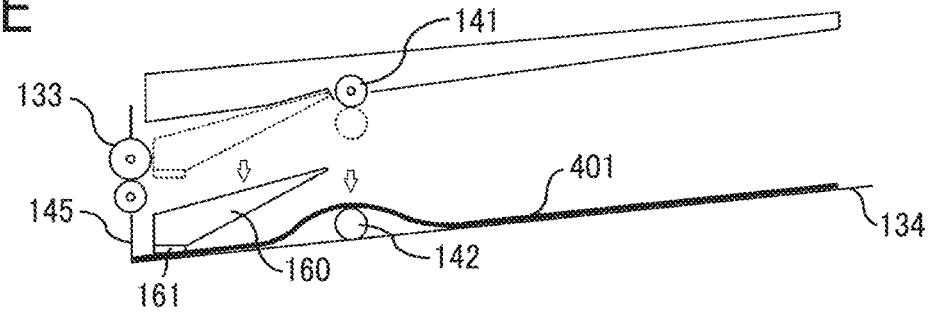

When the alignment roller 141 is stopped, the pressing member 142 is lowered and the branch plate 160 is lowered by a retreat device similar to the retreat device 146 illustrated in FIGS. 7A to 7D, and the ejected document is fixed by the friction member 161 (FIG. 13E). The raising control and the lowering control of the branch plate 160 may be configured to maintain a specific pressing force even when the number of stacked sheets increases, using a configuration such as the detector 1501 of the fifth embodiment. Alternatively, as in the switching device 144 illustrated in FIG. 6B, a lifting mechanism that performs linear motion moves the branch plate 160 that switches the conveyance path of the sheet, and switches the conveyance path of the sheet together with switching between contact and separation of the friction member 161.

Figure 13F:
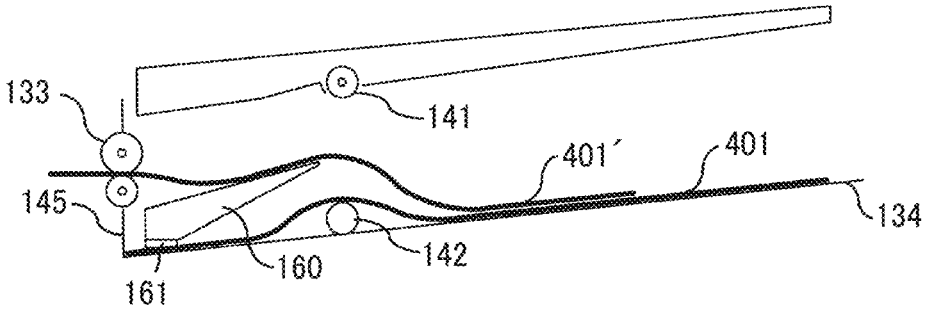

When the next document 401' is ejected, a trailing end portion of the stacked document is stored in the lower path of the branch plate 160 and fixed by the friction member 161. Such a configuration can avoid contact between the front end of the next document and the trailing end of the stacked document, ejection of the next document by the ejection roller 133, and accompanying feeding of the ejected document by the aligning operation of the next document by the alignment roller 141 (FIG. 13F). That is, the entire trailing end portion of the stacked sheets is pressed toward the ejection tray 134 by the branch plate 160. Such a configuration can prevent the curl of the trailing end portion of the stacked sheets from contacting the leading end of the ejected sheet and causing a jam. Note that, in order to prevent the next document from being ejected and stacked, the alignment roller 141 (the nipping portion between the alignment roller 141 and the pressing member 142) is made of a member having a smaller frictional force than that of the ejection roller 133 (the nipping portion). The friction member 161 is made of a member having a frictional force larger than that of the pressing member 142 or the ejection roller 133 (the nipping portion) in order to prevent co-feeding of the ejected document.

To be more specific, as illustrated in FIG. 14, while the ejection roller 133 is rotating in the forward feed direction, the controller 150 turns off the pressing by the retreat device similar to the retreat device 146 to move the pressing member 142 to the non-contact position, and lowers the branch plate 160 to a lowered position by a detector similar to the detector 1501 (S1401). The controller 150 confirms that the ejection sensor 132 has detected the trailing edge of the document 401 (S1402). The controller 150 determines whether the trailing edge of the document 401 has been conveyed to a position beyond the ejection roller 133 (S1403). If the controller 150 determines that the trailing edge of the document 401 has not been conveyed beyond the ejection roller 133 (NO in S1403), the controller 150 causes the ejection roller 133 to continue the conveyance of the document 401 (S1404). Alternatively, if the controller 150 determines that the trailing edge of the document 401 has been conveyed beyond the ejection roller 133 (YES in S1403), the controller 150 stops the ejection roller 133, turns on the pressing by the retreat device similar to the retreat device 146, and moves the pressing member 142 to the contact position (1405).

The controller 150 determines whether the trailing edge of the document 401 has been conveyed to a position beyond the downstream end portion P2 of the branch plate 160 (S1406). When the controller 150 determines that the trailing edge of the document 401 has not been conveyed to a position beyond the downstream end portion P2 of the branch plate 160 (NO in S1406), the controller 150 causes the alignment roller 141 to continue the conveyance of the document 401 (S1407). Alternatively when the controller 150 determines that the trailing edge of the document 401 has been conveyed to a position beyond the downstream end portion P2 of the branch plate 160 (YES in S1406), the controller 150 stops the alignment roller 141 and causes a mechanism similar to the detector 1501 to raise the branch plate 160 to the raised position (S1408).

When the branch plate 160 is raised, the controller 150 rotates the alignment roller 141 in reverse to start conveying the document 401 toward the ejection end fence 145 (S1409). The controller 150 determines whether the trailing edge of the document has been conveyed to the ejection end fence 145, based on the timing at which the trailing edge of the document has passed through the ejection sensor 132 (S1410). When the controller 150 determines that the trailing edge of the document has not been conveyed to the ejection end fence 145 (NO in S1410), the controller 150 causes the alignment roller 141 to continue the conveyance of the document 401 (S1411). Alternatively, when the controller 150 determines that the trailing edge of the document has been conveyed to the ejection end fence 145 (YES in S1410), the controller 150 stops the alignment roller 141, turns off the pressing by the retreat device similar to the retreat device 146, causes the pressing member 142 to move to the non-contact position, and causes the mechanism similar to the detector 1501 to lower the branch plate 160 (S1412). The number and arrangement of the alignment roller 141 are preferably the same as those of the ejection roller 133. The configuration of the ejection tray according to any of the first to seventh embodiments may be applied to an ejection tray of a post-processing apparatus built in a body of a copier.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure. The elements of the above-described embodiments can be modified without departing from the gist of the present disclosure, and can be appropriately determined according to the application form.

The invention claimed is:

1. A sheet feeder, comprising:

an ejection tray configured to stack sheets, the ejection tray including an ejection end fence configured to contact a trailing edge of the sheet on the ejection tray;

an ejector configured to eject a sheet to the ejection tray;

an aligner disposed downstream of the ejector in a direction of ejection of the sheet, the aligner including an alignment roller configured to rotate in a normal direction and a reverse direction to convey the sheet so that the trailing edge of the sheet abuts against the ejection end fence;

a pressing member including a spring configured to press the aligner into the ejection tray to enable the aligner to convey the sheet by rotation in the normal direction and the reverse direction;

a friction member upstream of the ejection end fence in the direction of the ejection of the sheet, the friction member configured to contact the sheet ejected on the ejection tray to prevent conveyance of the sheet when the trailing edge of the sheet abuts against the ejection end fence; and a switching device configured to switch contact and separation of the friction member with respect to the sheet.

2. The sheet feeder according to claim 1, further comprising a retreat device configured to switch presence and absence of pressure transmission to the aligner by the pressing member.

3. The sheet feeder according to claim 2, wherein the retreat device is an actuator.

4. The sheet feeder according to claim 2, wherein the retreat device is configured to detach the aligner from the sheet.

5. The sheet feeder according to claim 4, further comprising a detector configured to control a contact state of the sheet and the aligner with the retreat device so that a pressing force of the pressing member is constant.

6. The sheet feeder according to claim 5, wherein the detector includes a detection arm, and wherein the friction member is disposed at a distal end of the detection arm.

7. The sheet feeder according to claim 1, further comprising:

a branch plate configured to switch a conveyance path of the sheet, wherein the switching device is configured to move the branch plate to switch contact and separation of the friction member with respect to the sheet to switch the conveyance path of the sheet.

8. The sheet feeder according to claim 1, wherein a force of the friction member to prevent the conveyance of the sheet on the ejection tray is larger than a conveying force that another sheet conveyed by the aligner applies to the sheet on the ejection tray.

9. The sheet feeder according to claim 1, wherein the ejector is an ejection roller.

10. The sheet feeder according to claim 1, wherein the pressing member is a pressing roller.

11. An image reading device comprising the sheet feeder according to claim 1.

12. An image forming apparatus comprising the sheet feeder according to claim 1.

13. The sheet feeder according to claim 1, further comprising:

an ejection sensor configured to detect a leading edge and the trailing edge of the sheet; and a controller configured to, instruct the aligner to stop rotating in the normal direction after the trailing edge of the sheet is downstream of the friction member and before the trailing edge of the sheet passes through the aligner, and instruct the aligner to rotate in the reverse direction for a set period of time after the switching device separates the friction member.

14. The sheet feeder according to claim 13, instruct the controller is configured to instruct the aligner to rotate in the reverse direction for the set period of time after the switching device separates the friction member so that the trailing edge of the sheet abuts against the ejection end fence.

15. The sheet feeder according to claim 14, wherein the controller is configured to instruct the switching device to move the friction member to contact the sheet after the aligner rotates in the reverse direction for the set period of time so that the sheet is held in an aligned position against the ejection end fence.

16. The sheet feeder according to claim 1, wherein the ejection tray is a stationary ejection tray and the aligner and the friction member are both within the stationary ejection tray.

17. A sheet feeder, comprising:

an ejection tray configured to stack sheets;

an ejector configured to eject a sheet to the ejection tray;

an aligner disposed downstream of the ejector in a direction of ejection of the sheet, the aligner being rotatable in a normal direction and a reverse direction;

a pressing member configured to apply pressure between the sheet and the aligner to enable the aligner to convey the sheet by rotation in the normal direction and the reverse direction;

a friction member configured to contact the sheet ejected on the ejection tray to prevent conveyance of the sheet;

a switching device configured to switch contact and separation of the friction member with respect to the sheet; and a branch plate configured to switch a conveyance path of the sheet, wherein the switching device is configured to move the branch plate to switch contact and separation of the friction member with respect to the sheet to switch the conveyance path of the sheet.

* * * * *